US007088207B2

(12) United States Patent
Siedelhofer et al.

(10) Patent No.: US 7,088,207 B2
(45) Date of Patent: Aug. 8, 2006

(54) ELECTRICAL SWITCHING DEVICE FOR FAULT-CURRENT, OVERCURRENT AND SHORT-CIRCUIT CURRENT POSITION

(75) Inventors: Bernd Siedelhofer, Heidelberg (DE); Winrich Habedank, Leimen (DE); Jörg Puhr-Westerheide, Rauenberg-Malschenberg (DE); Heinz Throm, Vierheim (DE); Walter Kahl, Walldorf (DE); Klaus Fritsch, Hochdorf-Assenheim (DE)

(73) Assignee: ABB Patent GmbH, Ladenburg (DE)

( * ) Notice: Subject to any disclaimer, the term of this patent is extended or adjusted under 35 U.S.C. 154(b) by 363 days.

(21) Appl. No.: 10/444,591

(22) Filed: May 23, 2003

(65) Prior Publication Data

US 2003/0235021 A1 Dec. 25, 2003

Related U.S. Application Data

(63) Continuation of application No. PCT/EP01/12889, filed on Nov. 8, 2001.

(30) Foreign Application Priority Data

Nov. 23, 2000 (DE) ..... 100 58 075

(51) Int. Cl.
*H01F 7/00* (2006.01)

(52) U.S. Cl. ..... 335/234; 335/18; 335/172

(58) Field of Classification Search ..... 335/234
See application file for complete search history.

(56) References Cited

U.S. PATENT DOCUMENTS 4,288,770 A * 9/1981 Gillette ..... 335/173
4,301,435 A * 11/1981 Castonguay et al. ..... 335/26
6,147,422 A * 11/2000 Delson et al. ..... 310/14

FOREIGN PATENT DOCUMENTS

CH 395 271 12/1965

(Continued)

OTHER PUBLICATIONS

E. Kashy et al.: "A model to illustrate forces in nuclear fusion", *Am. J. Phys.*, vol. 62, No. 9, Sep. 1994, pp. 804-806.

*Primary Examiner*—Lincoln Donovan
(74) *Attorney, Agent, or Firm*—Laurence A. Greenberg; Werner H. Stemer; Ralph E. Locher

(57) ABSTRACT

An electrical switching device for fault-current, overcurrent and short-circuit current protection, has a contact point in a current path and a switching mechanism for permanently opening the contact point. The switching device further has a configuration for detecting the fault current, the overcurrent and the short-circuit current, and contains two permanent magnets and a core. The core is disposed between the like poles of the permanent magnets which point toward one another and one of which is fixed and the other is guided such that it can move. The permanent magnets are at least partially surrounded by a coil through which a fault, an overcurrent or a short-circuit current flows. When a current flow occurs in the coil, the magnetic field is changed causing a relative movement of the moving part, and the movement is transmitted to the contact point.

11 Claims, 1 Drawing Sheet

FOREIGN PATENT DOCUMENTS

| | | | |
|---|---|---|---|
| DE | 1 936 090 | | 4/1966 |
| DE | 1 538 370 | | 2/1970 |
| DE | 30 28 900 | A1 | 2/1982 |
| DE | 31 25 145 | A1 | 1/1983 |
| DE | 31 36 412 | A1 | 3/1983 |
| DE | 196 46 243 | C1 | 10/1997 |
| EP | 0 074 576 | A2 | 3/1983 |
| EP | 0 621 618 | A2 | 10/1994 |

* cited by examiner

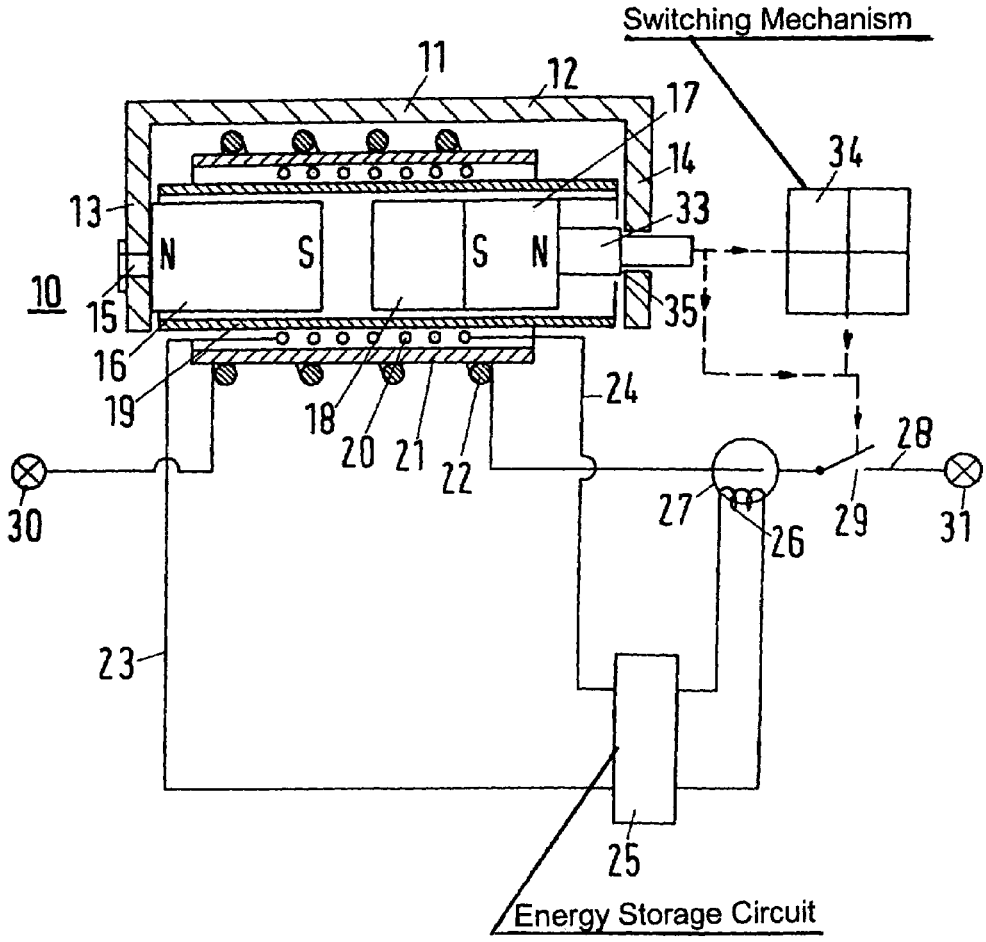
Switching Mechanism
11
12
17
14
34
13
33
N
S
S
N
10
15
35
16
19
18
20
21
22
24
28
30
27
26
29
31
23
25
Energy Storage Circuit

ELECTRICAL SWITCHING DEVICE FOR FAULT-CURRENT, OVERCURRENT AND SHORT-CIRCUIT CURRENT POSITION

CROSS-REFERENCE TO RELATED APPLICATION

This application is a continuation of copending International Application No. PCT/EP01/12889, filed Nov. 8, 2001, which designated the United States.

BACKGROUND OF THE INVENTION

Field of the Invention

The invention relates to an electrical switching device for fault-current, overcurrent and short-circuit current protection. The switching device has a current path with a contact point, a switching mechanism for permanently opening the contact point, and a configuration for detecting the fault-current, overcurrent and short-circuit current.

If they are intended to be used for overcurrent and short-circuit current protection, the electrical switching devices which are known at the moment have a thermal release in the form of a bimetallic strip, which bends when an overcurrent occurs and in the process unlatches a switching mechanism, as a result of which a contact point in the switching device is permanently opened. For short-circuit protection, an electromagnetic release is provided, which has a magnet core and a moving magnet armature, which are surrounded by a coil, and by which electromagnetic release, the contact point is directly opened and a switching mechanism is unlatched so that, in this situation, the contact point is opened permanently. Two releases have to be provided for both tripping methods, namely the thermal release and the electromagnetic release.

If the switching device is intended to disconnect a fault current, then the switching device has a transformer through which the current path (mains conductor) is passed. A secondary winding is disposed on the transformer and is connected to an electromagnetic release in the form of a holding magnet or a blocking magnet release, which acts on a switching mechanism such that the contact point is opened permanently.

Three releases need to be provided for all three protective measures, with the short-circuit current and overcurrent being detected in a switching device. The fault-current protection is carried out in a specific fault-current circuit breaker. This configuration of or this association between the individual switching devices for the corresponding protective measures is complex.

SUMMARY OF THE INVENTION

It is accordingly an object of the invention to provide an electrical switching device for fault-current, overcurrent and short-circuit current protection that overcomes the above-mentioned disadvantages of the prior art devices of this general type, which is simpler than the known switching device.

With the foregoing and other objects in view there is provided, in accordance with the invention, an electrical switching device for a fault-current, overcurrent and short-circuit current protection. The electrical switching device contains a current path having a contact point disposed therein, a switching mechanism for permanently opening the contact point, a configuration for detecting the fault-current, the overcurrent and the short-circuit current. The configuration contains two permanent magnets having like poles disposed opposite to one another, and a core permanently connected to one of the permanent magnets and composed of a magnetic material. The core is disposed between the like poles of the permanent magnets pointing towards one another and a first of the permanent magnets being fixed and a second of the permanent magnets being guided such that the second permanent magnet can move. At least one coil is provided and at least partially surrounds the permanent magnets, through the at least one coil the fault-current, the overcurrent or the short-circuit current can flow, so that, when a current flow occurs in the at least one coil, a magnetic field changes such that a relative movement of the second permanent magnet takes place, and being transmitted directly or through the switching mechanism to the contact point.

According to the invention, only one release is provided in the switching device, and is suitable for all the protective measures. Two permanent magnets are provided for this purpose, whose like poles are opposite one another, with a core, which is connected to one of the permanent magnets and is composed of magnetic material. The core is provided between the like poles of the permanent magnets that point towards one another and one of which is fixed and the other is guided such that it can move. The permanent magnets and the core are at least partially surrounded by at least one coil through which a fault current, an overcurrent or a short-circuit current flows, so that, when a current flow occurs in the at least one coil, the magnetic field is changed such that a relative movement of the moving part takes place, and is transmitted directly or via the switching mechanism to the contact point.

In this case, use is made of the effects of a model that simulates forces in core fusion processes, see Am. J. Phys. 62 (9), September 1994, pages 804 to 806. In the model described there, the moving parts are attracted with a maximum force of 17 N when the distance between them is less than about 2.6 mm while, in contrast, repulsion forces are produced when the distance between them is greater than 2.6 or 3 millimeters.

The coil makes it possible to influence the magnetic fields that are illustrated in FIG. 2 of the literature reference, so that attraction forces are overcome and only the repulsion forces act when a current flows through the coil. Since the moving part is repelled with a relatively high force, a switching mechanism can be unlatched, or a contact point can be opened directly. When a short-circuit current flows through the coil, the configuration acts as a short-circuit break contact or a short-circuit release, and when an overcurrent flows through the coil, it heats the core that is composed of magnetic material and, if this core is composed of a material which enters saturation at raised temperatures, acts as an overcurrent release. When a fault current flows through the coil, the release acts as a fault-current release.

In accordance with an added feature of the invention, the core is permanently connected to the second permanent magnet that can move. The core is composed of a material that changes its magnetic characteristics, in particular its permeability, as temperatures rise, and which enters saturation at increased temperatures.

According to one preferred refinement, a first coil is provided, which is connected via an energy storage circuit to the secondary winding of a current transformer so that a fault current is in consequence detected.

According to a further preferred refinement, a second coil is provided, which is located in the current path of the switching device and, acting as a short-circuit protection coil and overcurrent protection coil, drives the moving part of the release according to the invention.

A release with two coils is thus provided, which can carry out all the functions of a fault-current and line-protection circuit breaker.

In order to avoid stray losses, the release has an associated yoke as a magnetic return path, with the stationary part being attached to the yoke.

According to one particular embodiment of the invention, in the rest state, the magnets and the magnetic material touch and are repelled when a current flows through the coils.

According to a further refinement of the invention, the permanent magnets are held spaced apart in the rest state, and the magnetic fields act in such a way that they cause the magnets to be attracted when a current flows through the coil.

In order to guide the two parts, that is to say the moving part and the stationary part with respect to one another, the two parts are surrounded and guided by a coil former composed of nonmagnetic material.

At least one of the mutually touching surfaces of the two parts may, according to the invention, be coated with an anti-adhesion coating. This avoids adhesion processes between the moving parts.

Other features which are considered as characteristic for the invention are set forth in the appended claims.

Although the invention is illustrated and described herein as embodied in an electrical switching device for fault-current, overcurrent and short-circuit current protection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing shows a diagrammatic, sectional view of a release according to the invention.

DESCRIPTION OF THE PREFERRED EMBODIMENTS

Referring now to the single FIGURE of the drawing in detail, there is shown a release 10 that has a yoke 11, which is provided in a U-shape with a web 12 and two limbs 13 and 14 which run at right angles to the web 12. A first permanent magnet 16 is attached to the limb 13 by a rivet 15, to be precise with a north pole N on the limb 13. The release 10 has a second associated permanent magnet 17, whose north pole N is adjacent to the limb 14 while, in contrast, a south pole S of the second permanent magnet 17 is opposite a south pole S of the first permanent magnet 16. A core 18 is located between the two permanent magnets 16 and 17, and is composed of magnetic material whose permeability is dependent on the temperature such that the core 18 enters saturation at raised temperatures. In this refinement, the core 18 is magnetically connected to the second permanent magnet 17. The two permanent magnets 16 and 17 together with the core 18 are surrounded by an inner coil former 19 which, for example, is composed of plastic or the like.

A first coil 20 is wound around the inner coil former 19, and the coil 20 is surrounded by a second coil former 21, on whose outside a second coil 22 is wound. The inner coil or first coil 20 is connected by its connections 23 and 24 to an energy storage circuit 25, whose input is connected to a secondary winding 26 of a transformer 27, through whose primary winding a current path 28 passes, in which a contact point 29 is located. The second coil 22 is located in the current path 28, and the ends of the current path 28 are connected to connecting terminals 30 and 31.

The north pole N of the second permanent magnet 17 is adjacent to a plunger 33 which acts on the contact point 29 on the one hand via a switching mechanism 34 and on the other hand directly, with the lines of action being shown by dashed lines. The plunger 33 is composed of a nonmagnetic material and has a step 35 that comes to rest against the inner surface of the yoke 14, shown in the switched-off state, so that the movement of the second permanent magnet 17 is limited by the core 18.

When the transformer 27 detects a fault current, then the energy storage circuit 25 is charged and a suitable magnetic field is produced via the coil 20 so that the two parts which are touching one another are separated, with the repulsion effect between like poles moving them toward the tripped position, as shown in the FIGURE.

The contact point 29 is thus opened permanently via the switching mechanism 34.

When an overcurrent occurs in the current path 28, then the core 18 is heated; in consequence, the permeability of the core 18 changes, so that it enters saturation and is then, from the magnetic point of view, air. The two permanent magnets thus repel one another, and the contact point 29 is opened permanently via the switching mechanism 34.

When a short-circuit current flows in the current path 28, then the magnetic field is changed via the coil 22 such that the poles repel one another and the plunger 33 acts on the contact point 29 both directly and via the switching mechanism 34.

The refinement according to the invention thus acts as a release for a fault current, an overcurrent and a short-circuit current. This is achieved by the association between the two permanent magnets and the core 18 within the coils 20 and 22.

We claim:

1. An electrical switching device for a fault-current, overcurrent and short-circuit current protection, the electrical switching device comprising:

a current path having a contact point disposed therein;

a switching mechanism for opening said contact point;

a configuration for detecting the fault-current, an overcurrent and an short-circuit current, said configuration containing two permanent magnets having like poles disposed opposite to one another, and a core permanently connected to one of said permanent magnets and composed of a magnetic material, said core disposed between said like poles of said permanent magnets pointing towards one another and a first of said permanent magnets being fixed and a second of said permanent magnets being guided such that said second permanent magnet can move; and at least one coil at least partially surrounding said permanent magnets, said at least one coil being part of said current path and through said coil a current flow from the fault-current, the overcurrent or the short-circuit current can flow, so that, when the current flow occurs in said at least one coil, a magnetic field changes such that a relative movement of said second permanent magnet takes place, and the relative movement being transmitted directly or through said switching mechanism to said contact point.

2. The device according to claim 1, wherein said core is permanently connected to said second permanent magnet which can move.

3. The device according to claim 1, further comprising:

a current transformer having a primary winding and a secondary winding; and a further coil;

an energy store having a first end and a second end, said further coil is connected to said first end of said energy storage circuit, said second end is connected to said secondary winding such that the fault-current is detected and the magnetic field is changed.

4. The device according to claim 1, wherein said core is composed of a material which changes its magnetic characteristics, as temperatures rise, and which enters saturation at increased temperatures.

5. The device according to claim 1, further comprising a yoke functioning as a magnetic return path, and said first permanent magnet is attached to said yoke.

6. The device according to claim 1, wherein in a rest state, said permanent magnets touch said core and are attracted to said core, and are repelled when a current flows through said at least one coil.

7. The device according to claim 1, wherein in a rest state, said permanent magnets are held spaced apart and are attracted when a current flows through said at least one coil.

8. The device according to claim 3, further comprising an inner coil former composed of a nonmagnetic material, said permanent magnets together with said core are surrounded and guided by said inner coil former.

9. The device according to claim 8, further comprising a further coil former surrounding said further coil.

10. The device according to claim 8, wherein at least one of said second permanent magnet and said inner coil former is coated with an anti-adhesion coating.

11. The device according to claim 4, wherein said material of said core changes its permeability, as the temperatures rise.

* * * * *

UNITED STATES PATENT AND TRADEMARK OFFICE

CERTIFICATE OF CORRECTION

PATENT NO. : 7,088,207 B2
APPLICATION NO. : 10/444591
DATED : August 8, 2006
INVENTOR(S) : Bernd Siedelhofer et al.

It is certified that error appears in the above-identified patent and that said Letters Patent is hereby corrected as shown below:

Title Page
Item (54) The Title should read as follows:

--Electrical Switching Device for Fault-Current, Overcurrent and Short-Circuit Current Protection--

Signed and Sealed this

Twenty-first Day of November, 2006

JON W. DUDAS
*Director of the United States Patent and Trademark Office*